US006976311B2

(12) United States Patent
Lee

(10) Patent No.: US 6,976,311 B2
(45) Date of Patent: Dec. 20, 2005

(54) METHOD AND APPARATUS FOR ATTACHING AND DETACHING TWO UTENSILS

(76) Inventor: Victor W. Lee, 22 Aspen Dr., Livingston, NJ (US) 07039

( * ) Notice: Subject to any disclaimer, the term of this patent is extended or adjusted under 35 U.S.C. 154(b) by 121 days.

(21) Appl. No.: 10/665,926

(22) Filed: Sep. 19, 2003

(65) Prior Publication Data

US 2005/0060890 A1 Mar. 24, 2005

(51) Int. Cl.[7] ..... B26B 1/02
(52) U.S. Cl. ..... 30/155; 30/152; 30/146
(58) Field of Search ..... 30/146, 147, 148, 30/149, 299, 304, 155, 322, 324, 152, 161

(56) References Cited

U.S. PATENT DOCUMENTS

| | | | | | |
|---|---|---|---|---|---|
| 32,916 | A | * | 7/1861 | Richards | 30/147 |
| 562,946 | A | | 6/1896 | Anderson | |
| 766,059 | A | * | 7/1904 | Palmer | 30/153 |
| 927,352 | A | | 7/1909 | Hoglund et al. | |
| 1,165,226 | A | | 12/1915 | Cassady | |
| 1,425,750 | A | * | 8/1922 | Crawford | 30/148 |
| 2,456,858 | A | * | 12/1948 | Bolling | 30/143 |
| 2,753,631 | A | | 7/1956 | Culver | 30/296 |
| 3,363,315 | A | * | 1/1968 | Anderson | 30/152 |
| 3,570,125 | A | | 3/1971 | Hahn | 30/296 |
| 4,528,707 | A | | 7/1985 | Aida | 7/131 |
| 4,658,456 | A | * | 4/1987 | Tsai | 7/135 |
| 4,908,947 | A | * | 3/1990 | Schaub | 30/155 |
| 5,794,346 | A | * | 8/1998 | Seber et al. | 30/161 |
| 5,815,866 | A | * | 10/1998 | Janky | 7/114 |
| 5,845,403 | A | * | 12/1998 | Nivin | 30/147 |
| D419,851 | S | * | 2/2000 | Cheng | D8/107 |
| 6,101,724 | A | * | 8/2000 | Halligan | 30/161 |

* cited by examiner

*Primary Examiner*—Hwei-Siu Payer
(74) *Attorney, Agent, or Firm*—Walter J. Tencza, Jr.

(57) ABSTRACT

An apparatus is provided comprising a first knife and a second knife. The first knife typically includes a first attachment device and the second knife includes a second attachment device to attach the two knives together. The first and second attachment devices can be detached to detach the two knives from each other. The first and second knives can be folding type knives. The first attachment device may be comprised of a first plate having an opening. The second attachment device may be comprised of a protrusion. The protrusion of the second attachment device can be inserted into the opening of the first plate to attach the first knife to the second knife.

20 Claims, 17 Drawing Sheets

METHOD AND APPARATUS FOR ATTACHING AND DETACHING TWO UTENSILS

FIELD OF THE INVENTION

This invention relates to improved methods and apparatus concerning utensils.

BACKGROUND OF THE INVENTION

Typically in the prior art utensils, such as forks or knives, are provided separate from each other. There are holders, which are known in the art such as holder 6 in U.S. Pat. No. 2,753,631 to Culver for holding two knifes. However, the knives shown in Culver, must be removed from the holder 6 in order to be used. The holder 6 is not part of the knives. There are folding type knives, which include various tools, such as disclosed in U.S. Pat. No. 927,352 to Hoglund et al. The tools in the folding type knives typically can rotate into an open or closed position but cannot be detached from the knife.

SUMMARY OF THE INVENTION

The present invention in one or more embodiments provides an apparatus comprising a first utensil and a second utensil, such as a first knife and a second knife. The first knife typically includes a first attachment device and the second knife typically includes a second attachment device, wherein the first attachment device and the second attachment device can be attached to each other to attach the first knife to the second knife. The first attachment device and the second attachment device can be easily detached from each other to detach the first knife from the second knife. The first and second knives may be folding type knives.

The first knife may be comprised of first and second blades, and the second knife may be comprised of third and fourth blades. The first attachment device may be comprised of a first plate having an opening. The second attachment device may be comprised of a protrusion. The protrusion of the second attachment device can be inserted into the opening of the first plate to attach the first knife to the second knife. The second attachment device may be comprised of a second plate attached to the protrusion.

The first attachment device may also be comprised of a third plate having an opening, which is substantially aligned with the opening of the first plate. The protrusion typically can be inserted into the opening of the third plate to attach the first knife to the second knife. The opening in the first plate of the first attachment device may have a first substantially rectangular portion, a substantially circular portion, and a second substantially rectangular portion. First and second protruding stops may be provided which protrude into the opening of the third plate of the first attachment device and prevent the first knife from rotating more than one hundred and eighty degrees with respect to the second knife, after the second knife is attached to the first knife.

The first and second blades may be able to rotate from a closed position within the first knife to an open position. The third and fourth blades may be able to rotate from a closed position within the first knife to an open position. The first knife may have a clip.

The second attachment device may be inserted into the first attachment device, when the first knife is place at an angle with respect to the second knife. The first knife may be rotated with respect to the second knife to cause the first and second knife to lock in a state of alignment with respect to each other. First and second rotating balls may be attached to the first plate of the first attachment device, so that the balls can rotate but remain in the same position. The second plate may include a first ball opening and a second ball opening. The first rotating ball can be inserted into the first ball opening and the second rotating ball can be inserted into the second ball opening in order to lock the first knife in a first position with respect to the second knife. The second plate may include a third ball opening and a fourth ball opening. The first rotating ball can be inserted into the third ball opening and the second rotating ball can be inserted into the fourth ball opening in order to lock the first knife in a second position with respect to the second knife, wherein the first position differs from the second position.

The present invention in one or more embodiments also includes a method comprising attaching a first attachment device of a first knife to a second attachment device of a second knife, in order to attach the first knife and the second knife together, and thereafter detaching the first attachment device from the second attachment device to detach the first knife from the second knife.

DETAILED DESCRIPTION OF THE DRAWINGS

Figure 4A:
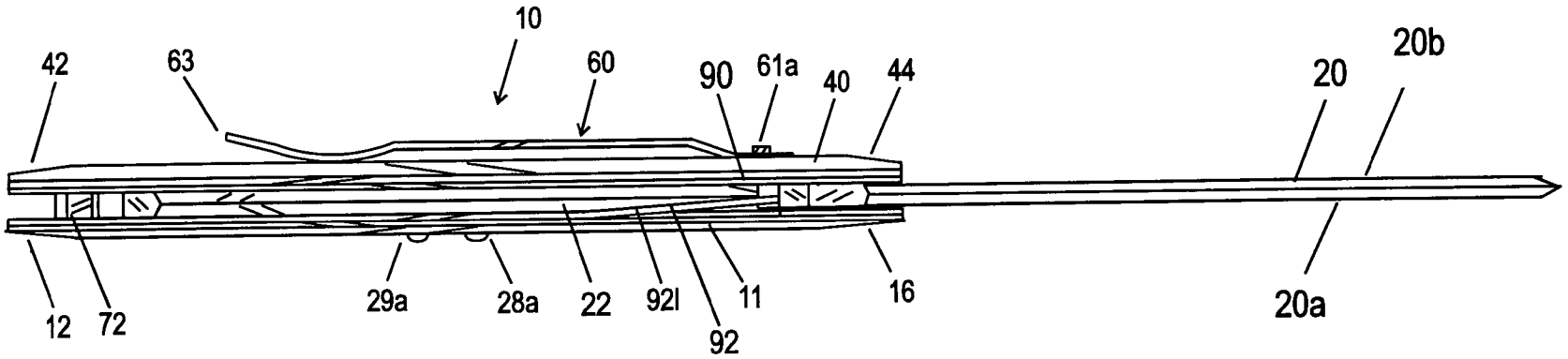
FIG. 4A shows a right side view of the first knife of FIG. 1A with a first blade of the first knife in an open state.
Figure 4B:
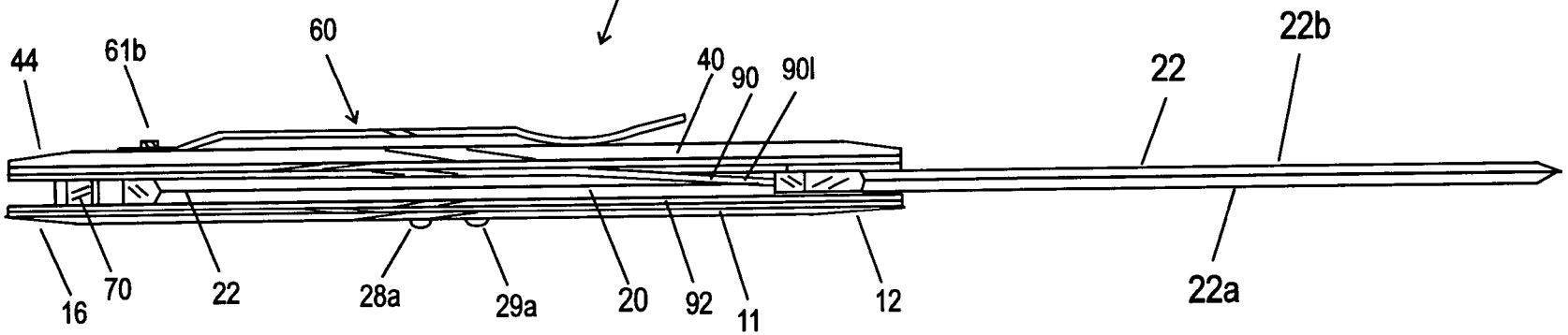
FIG. 4B shows a left side view of the first knife of FIG. 1A with a second blade of the first knife in an open state.
Figure 12A:
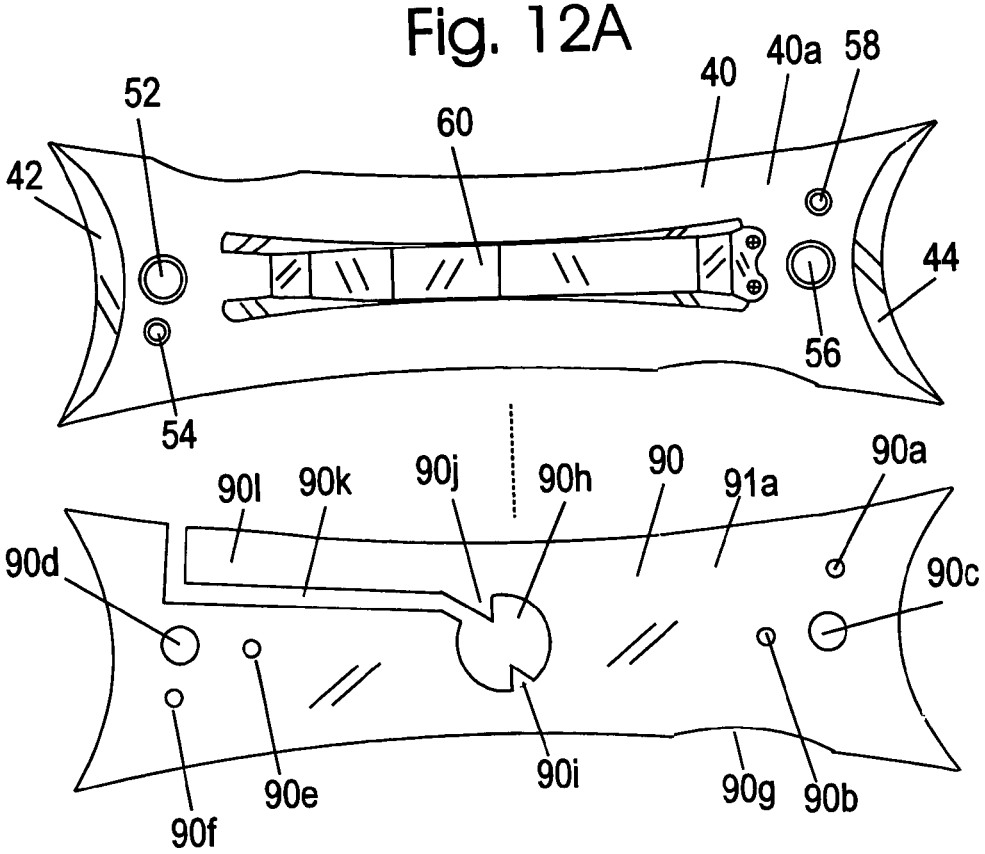
FIG. 12A shows a top view of a first plate and a second plate of the first knife.
Figure 12B:
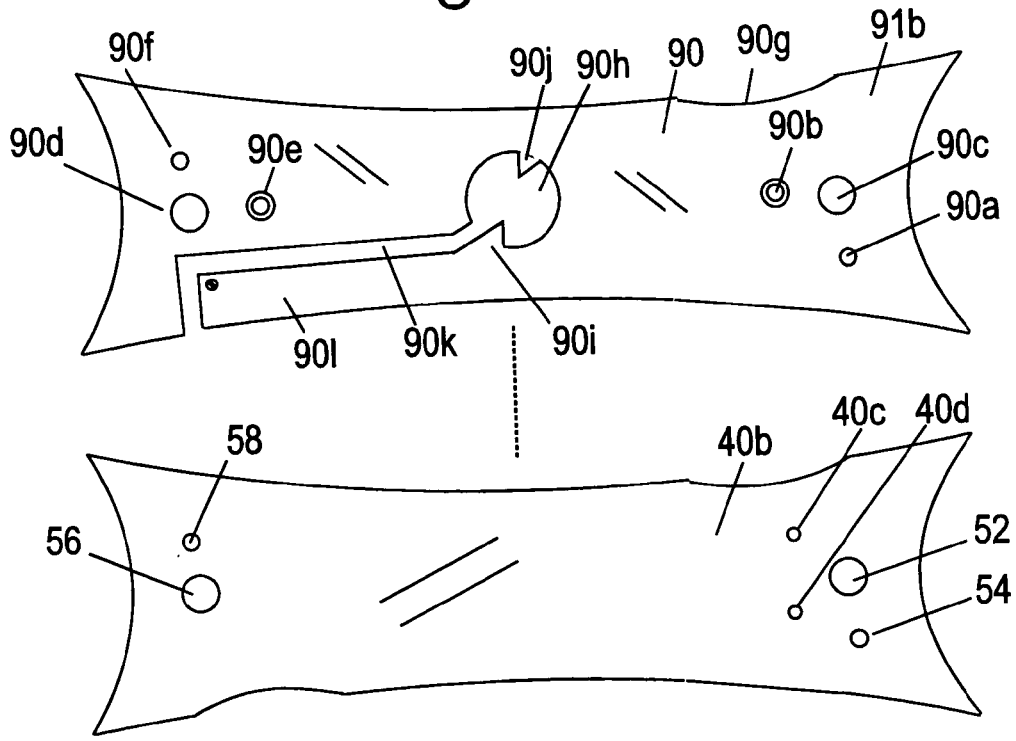
FIG. 12B shows a bottom view of the first plate and the second plate of the first knife.
Figure 13A:
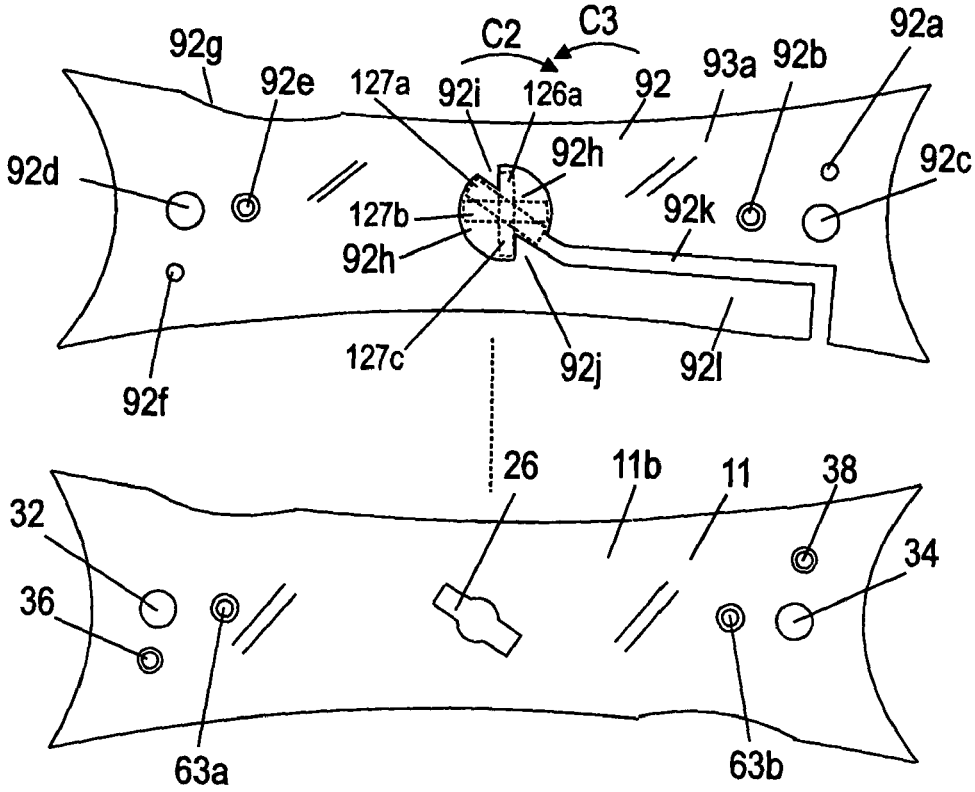
FIG. 13A shows a top view of a third plate and a fourth plate of the first knife, with dashed lines showing various locations for the protrusion of the second knife to be inserted into the third plate.
Figure 13B:
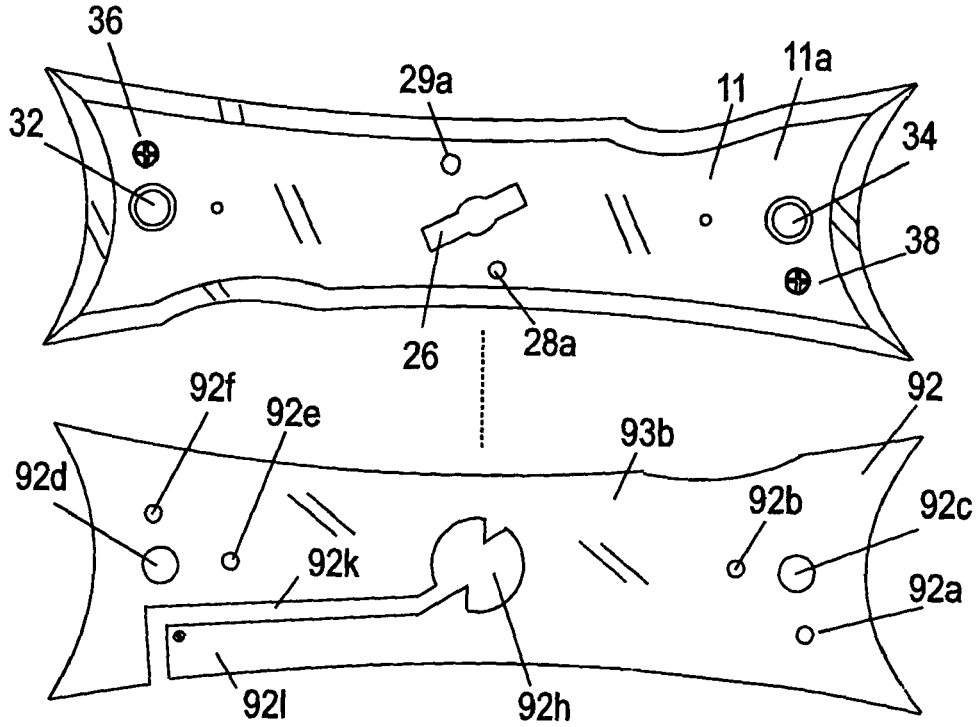
FIG. 13B shows a bottom view of the third plate and the fourth plate of the first knife.
Figure 16:
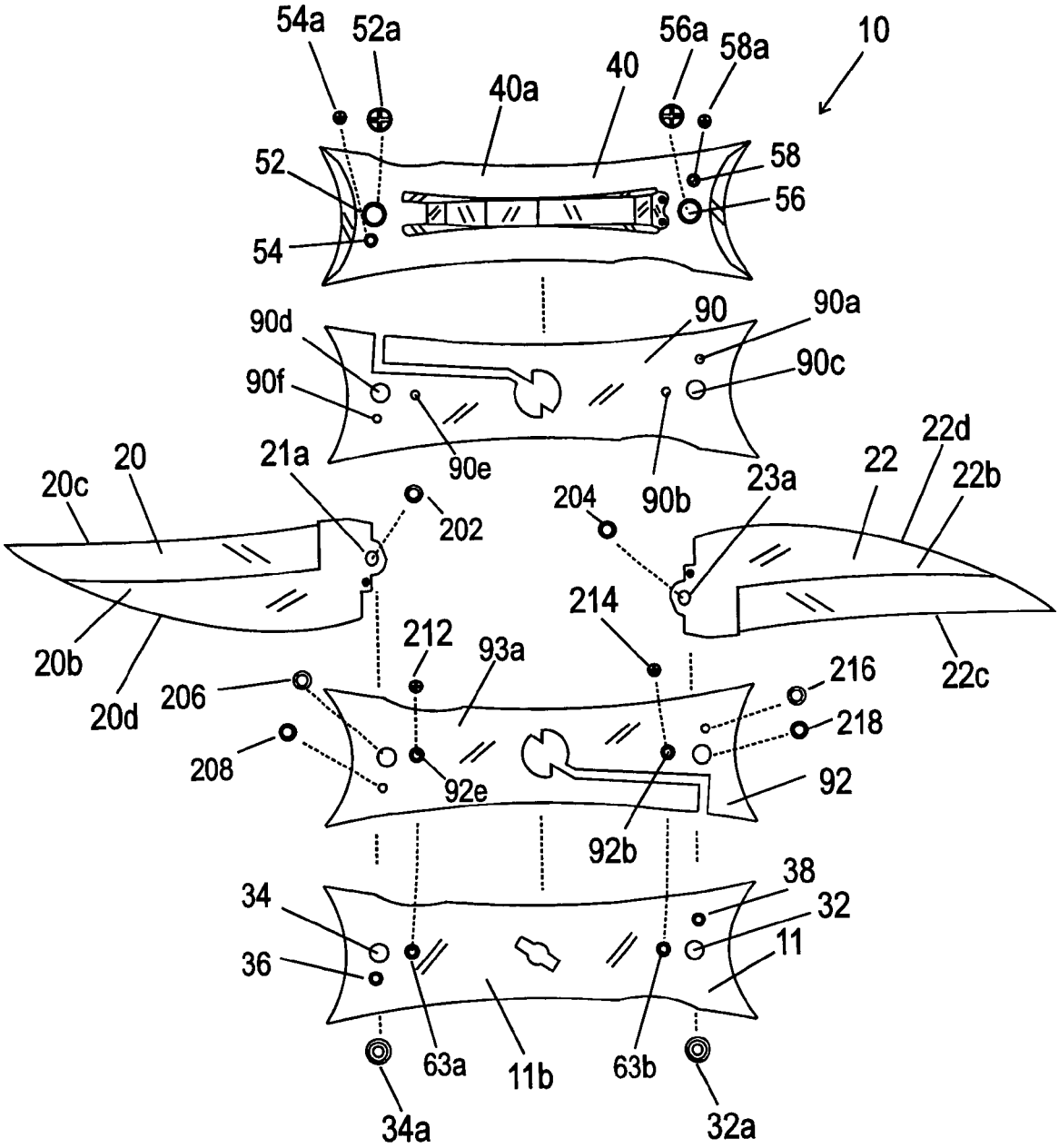
FIG. 16 shows a top view of components of the first knife taken apart.

FIGS. 1A, 1B, 2A, 2B, 3A, and 3B show bottom, top, rear, front, right side, and left side views, respectively of a first knife 10, in accordance with an embodiment of the present invention, wherein the first knife 10 is in a closed state. FIGS. 4A and 4B show right and left side views of the first knife 10 with a first blade 20 and a second blade 22, respectively, in an open state. FIGS. 12A–12B show top and bottom views of a first or top plate 40 and a second plate 90 respectively, of the first knife 10. FIGS. 13A–13B show top and bottom views of a third plate 92 and a fourth or bottom plate 11 respectively, of the first knife 10. FIG. 16 shows a top view of the first knife 10 taken apart.

Referring to FIGS. 1A–4B, 12A–13B, and 16, the first knife 10 includes the first or top plate 40, the second plate 90, the blade 20, the blade 22, the third plate 92, and the fourth or bottom plate 11.

Figure 1A:
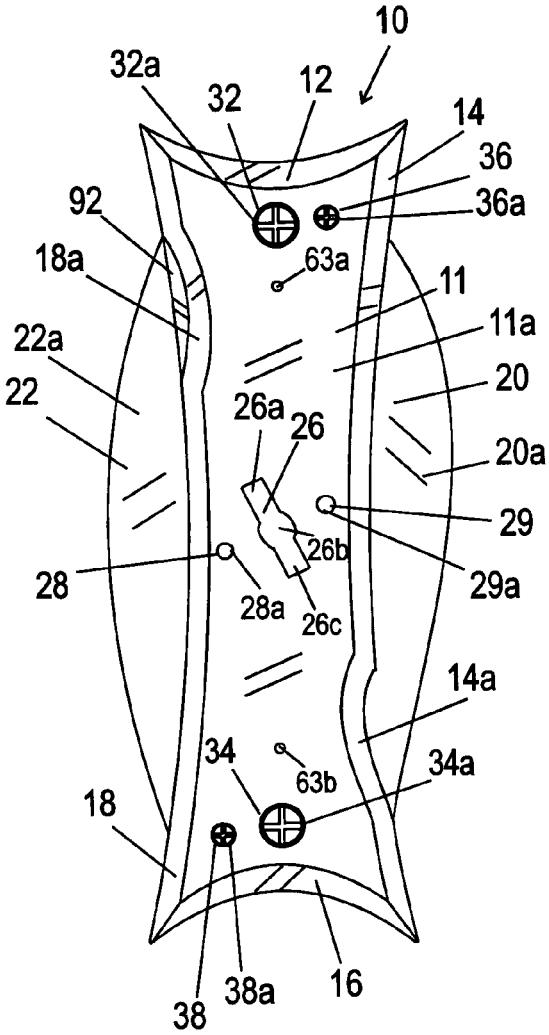
FIG. 1A shows a bottom view of a first knife in accordance with an embodiment of the present invention, with the first knife in a closed state.
Figure 1B:
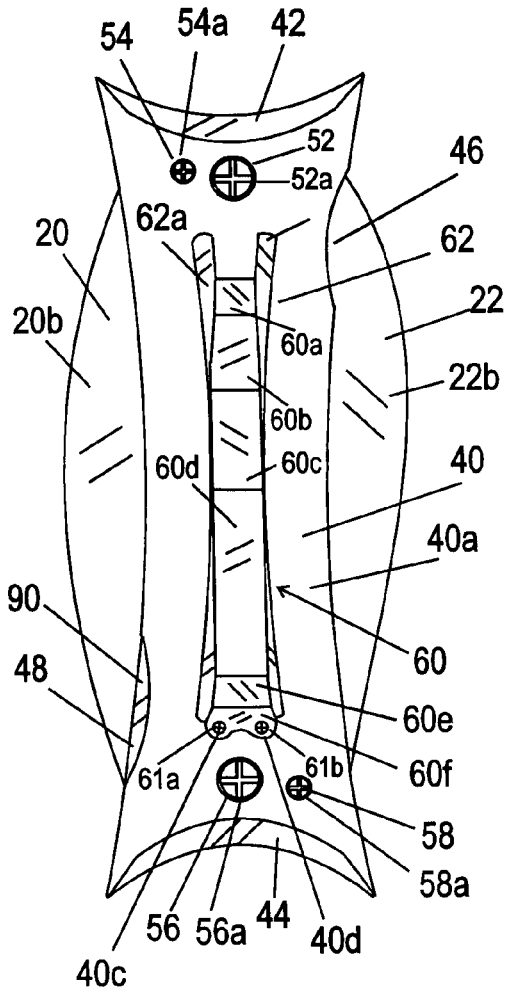
FIG. 1B shows a top view of the first knife of FIG. 1A, with the first knife in a closed state.
Figure 2A:
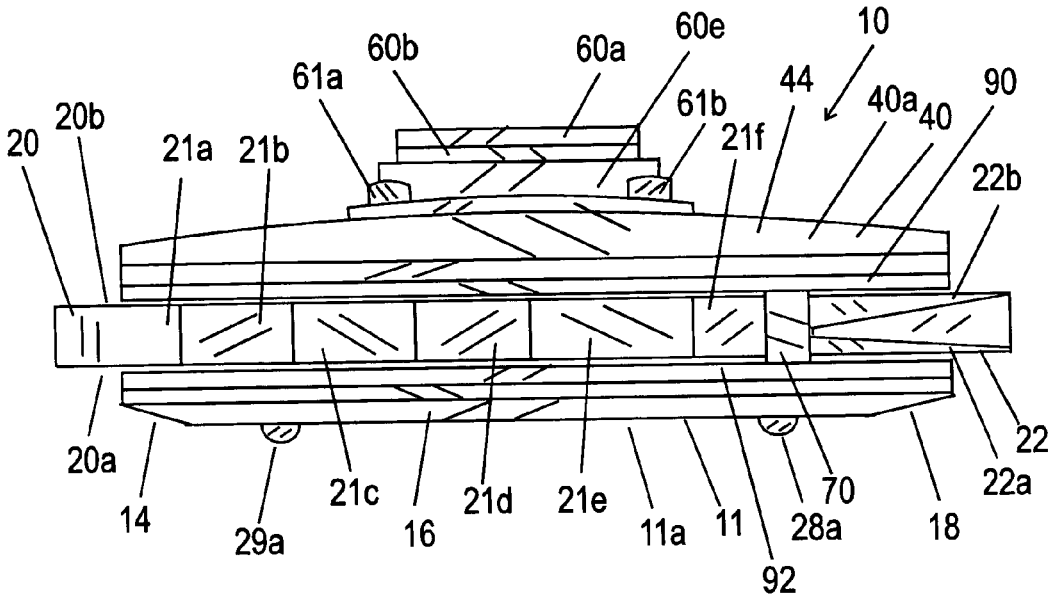
FIG. 2A shows a rear view of the first knife of FIG. 1A, with the first knife in a closed state.
Figure 2B:
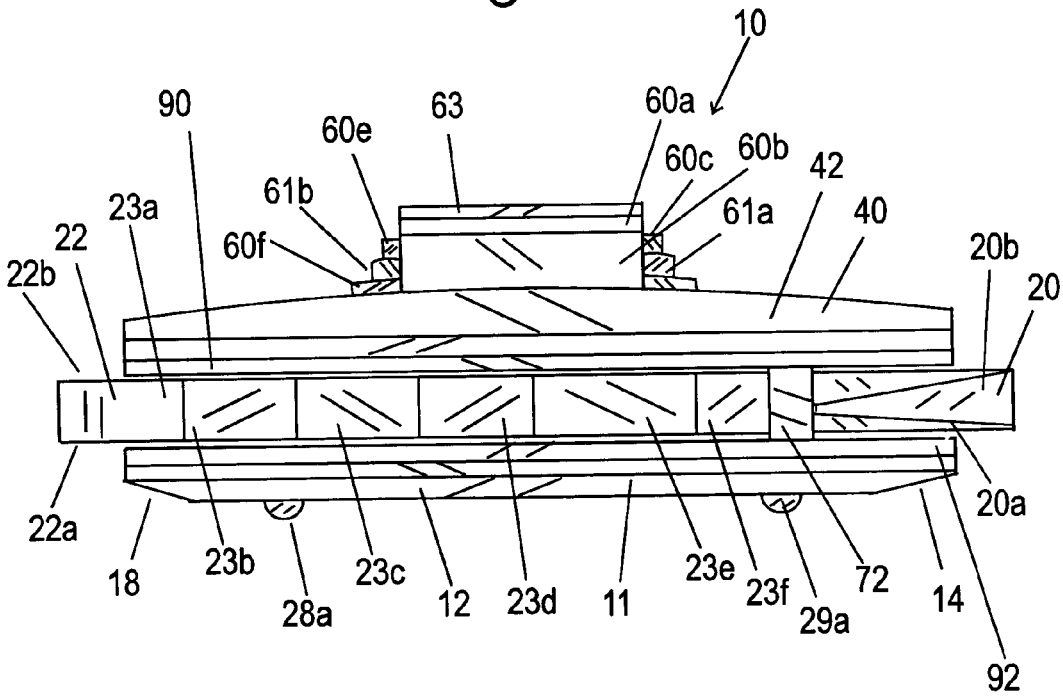
FIG. 2B shows a front view of the first knife of FIG. 1A, with the first knife in a closed state.
Figure 3A:
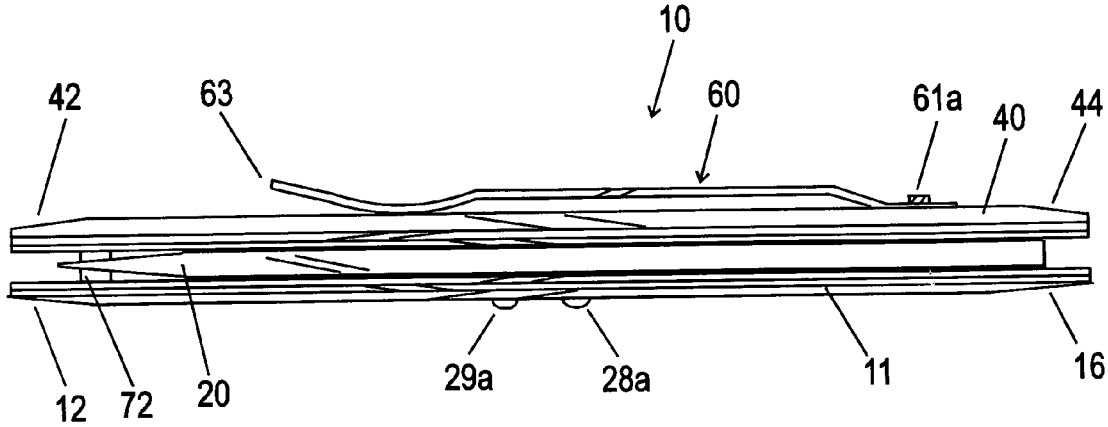
FIG. 3A shows a right side view of the first knife of FIG. 1A, with the first knife in a closed state.
Figure 3B:
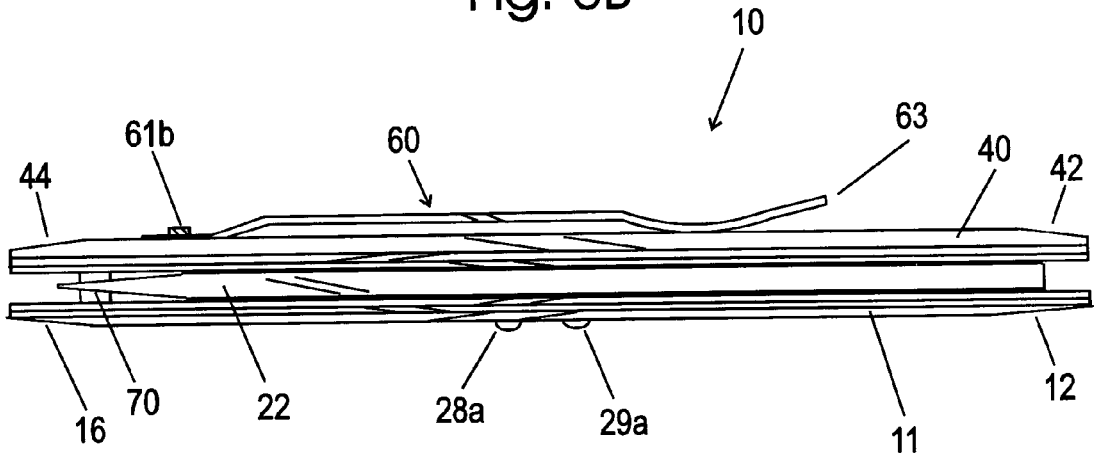
FIG. 3B shows a left side view of the first knife of FIG. 1A, with the first knife in a closed state.

The first or top plate 40 has a surface 40*a* shown in FIG. 1B and FIG. 12A and a surface 40*b* shown in FIG. 12B. The surface 40*a* of the top plate 40 includes tapered fringes or portions 42 and 44. The plate 40 includes indented portions 46 and 48. The top plate 40 has openings 52, 54, 56, 58, and 40*c* and 40*d* through which screws can be inserted. A clip 60 is fixed to the top plate 40. The clip 60 has portions 60*a*, 60*b*, 60*c*, 60*d*, 60*e*, and 60*f*. The clip 60 is fixed to the surface 40*a* by screws 61*a* and 61*b* through openings 40*c* and 40*d*, respectively. The openings 40*c* and 40*d* may be delimited by inner surfaces of the plate 40 which may be threaded.

The second plate 90 has surfaces 91*a* and 91*b* shown in FIGS. 12A and 12B, respectively. The second plate 90 has openings 90*a*, 90*b*, 90*c*, 90*d*, 90*e*, and 90*f*. The second plate 90 has an indented portion 90*g*. The second plate 90 has a central opening 90*h*. Protruding stops or triangular portions 90*i* and 90*j* protrude into the opening 90*h*. There is a flexed portion 90*l*, which is separated from the adjacent part of the second plate 90 by a channel 90*k*. The flexed portion 90*l* as shown in FIG. 12A, may be flexed or biased downwards in a direction into the page.

The blade 20 has a surface 20*a*, a surface 20*b*, a cutting edge 20*c*, and a non-cutting edge 20*d*. The non-cutting edge 20*d* is typically thicker than the cutting edge 20*c*. The blade 20 also has a hole 21*a*. The blade 22 similarly has a surface 22*a*, a surface 22*b*, a cutting edge 22*c*, and a non-cutting edge 22*d*. The non-cutting edge 22*d* is typically thicker than the cutting edge 22*c*. The blade 20 also has a hole 23*a*.

The third plate 92 may be substantially similar to the second plate 90. The third plate 92 has surfaces 93*a* and 93*b* shown in FIGS. 13A and 13B. The third plate 92 has openings 92*a*, 92*b*, 92*c*, 92*d*, 92*e*, and 92*f*. The third plate 92 has an indented portion 92*g*. The third plate 92 has a central opening 92*h*. Protruding stops or triangular portions 92*i* and 92*j* protrude into the opening 92*h*. There is a flexed portion 92*l*, which is separated from the adjacent part of the third plate 92 by a channel 92*k*. The flexed portion 92*l* as shown in FIG. 13A, may be flexed or biased upwards in a direction out of the page.

The bottom plate 11 has a surface 11*a* shown in FIG. 1A and FIG. 13B. The surface 11*a* of the bottom plate 11 includes tapered fringes or portions 12, 14, 16, and 18. The fringe portion 14 has an indented portion 14*a*. The fringe portion 18 has an indented portion 18*a*. The bottom plate 11 has a substantially centrally located opening 26 having a substantially rectangular portion 26*a*, a substantially circular portion 26*b*, and a substantially rectangular portion 26*c*. The bottom plate 11 also includes metal balls 28*a* and 29*a*, which can rotate within openings 28 and 29, respectively. The plate 11, including key shaped opening 26 and balls 28*a* and 29*a* may be considered an attachment device for attaching the knife 10 to a knife 100. The bottom plate 11 has openings 32, 34, 63*a* and 63*b* through which screws can be inserted. The bottom plate 11 also has posts 36 and 38 fixed to it, which have threaded openings for insertion of screws.

Referring to FIG. 16, the first knife 10 may be assembled as follows. The plate 92 may be placed and aligned over the plate 11 so that the surface 93*b* of the plate 92 contacts the surface 11*b* of the plate 11. The plate 92 may then be secured to the plate 11 by attaching a threaded end of screw 212 through openings 92*e* and 63*a* and a threaded end of screw 214 through openings 92*b* and 63*b*. Post screws 34*a* and 32*a* can be inserted through openings 34 and 32, respectively, up through the surface 11*a* through plate 11 and then through the surface 11*b*. Washers 206 and 208 can be placed on post screw 34*a* and on post 36, respectively. Washers 216 and 218 can be placed on post 38 and on post screw 32*a*. The blade

20 can be placed on top of the plate 92, so that the surface 20*a* of the blade 20 is adjacent to the surface 93*a* of the plate 92 and a portion of the post 34*a* is inserted through the hole 21*a* of the blade 20. This allows the blade 20 to rotate using the post 34*a* as a pivot point. Similarly, the blade 22 can be placed on top of the plate 92, so that the surface 22*a* of the blade 22 is adjacent to the surface 93*a* of the plate 92 and a portion of the post 32*a* is inserted through the hole 23*a* of the blade 22. This allows the blade 22 to rotate using the post 32*a* as a pivot point.

A washer 202 is placed over the blade 20 so that a portion of the post 34*a* is inserted into the washer 202. Similarly a washer 204 is placed over the blade 22 so that a portion of the post 32*a* is inserted into the washer 204. Next the plate 90 is placed and aligned over the plate 92, with the blades 20 and 22 in between the plate 90 and the plate 92. Part of the post 34*a* is inserted through the opening 90*d* in the plate 90 and part of the post 32*a* is inserted through the opening 90*c*. Part of the post 36 is inserted through the opening 90*f* and part of the post 38 is inserted through the opening 90*a*. Next, the plate 40 is placed and aligned over the plate 92. Part of the post 34*a* is inserted into the opening 52, part of the post 32*a* is inserted through the opening 56, part of the post 36 is inserted through the opening 54 and part of the post 38 in inserted through the opening 58. Screw 52*a* is inserted into the opening 52 and connected to the post 34*a*, screw 54*a* is inserted into the opening 54 and connected to the post 36, screw 56*a* is inserted into the opening 56 and connected to the post 32*a*, and screw 58*a* is inserted into the opening 58 and connected to the post 38.

When fully assembled the first knife 10 operates as follows. Each of the blades 20 and 22 can be placed in a closed state as shown in FIGS. 1A–3B, or in an open state as shown by FIGS. 4A and 4B. The blades 20 and 22 may both be open at the same time. When the blade 20 is in the fully open state shown in FIG. 4A, the portion 92*l* of the plate 92 flexes inward towards the plate 40 and thereby contacts the blade 20, keeping the blade 20 in the open position. The portion 92*l* is biased or flexed so that when the blade 20 is not pressing down on it, it flexes toward the plate 40. The blade 20 can only be placed back in the closed position by pushing the portion 92*l* plate 92 (i.e. portion 92*l*) back downwards towards the plate 11, allowing the blade 20 to slide over and press down on the plate 92. Similarly, when the blade 22 is in the fully open state shown in FIG. 4B, the portion 90*l* of plate 90 flexes inward towards the plate 11 and thereby contacts the blade 22 keeping the blade 22 in the open position. The portion 90*l* is biased or flexed so that when the blade 22 is not pressing down on it, it flexes toward the plate 11. The blade 22 can only be placed back in the closed position by pushing the portion 90*l* of the plate 90 back downwards towards the plate 40, allowing the blade 22 to slide over and press down on the plate 90.

Figure 8A:
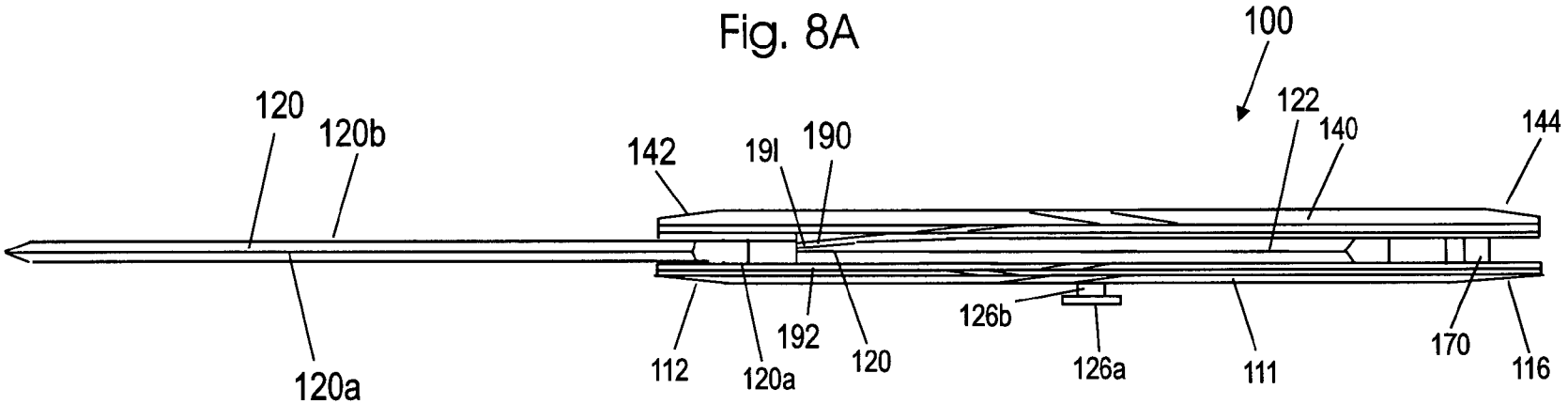
FIG. 8A shows a right side view of the second knife of FIG. 5A with a first blade of the second knife in an open state.
Figure 8B:
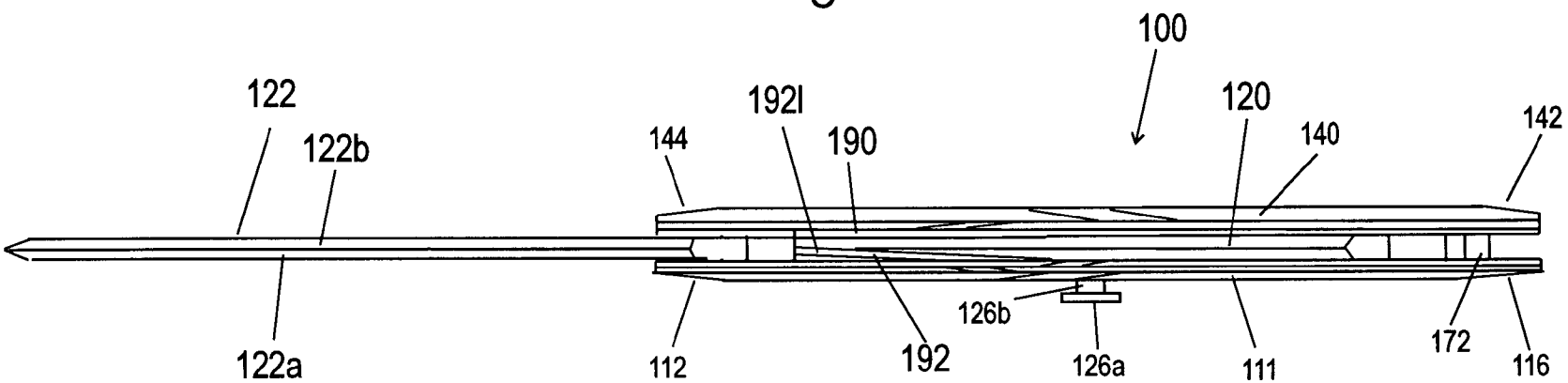
FIG. 8B shows a left side view of the second knife of FIG. 5A with a second blade of the second knife in an open state.
Figure 14A:
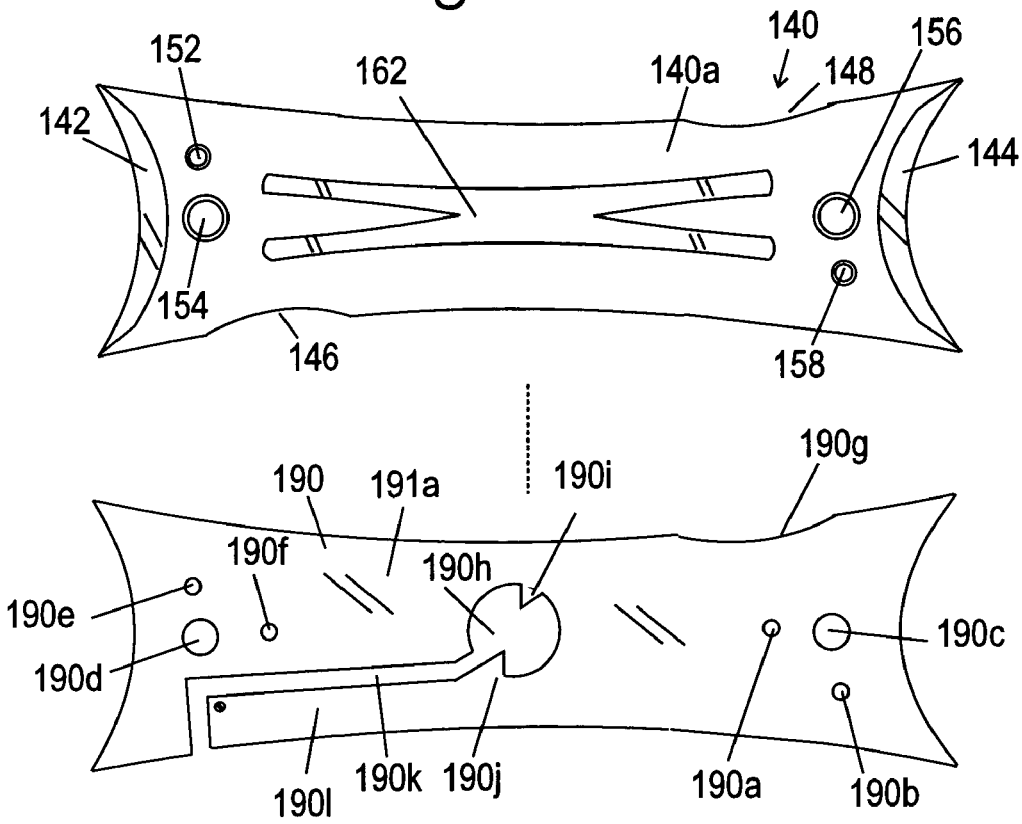
FIG. 14A shows a top view of a first plate and a second plate of the second knife.
Figure 14B:
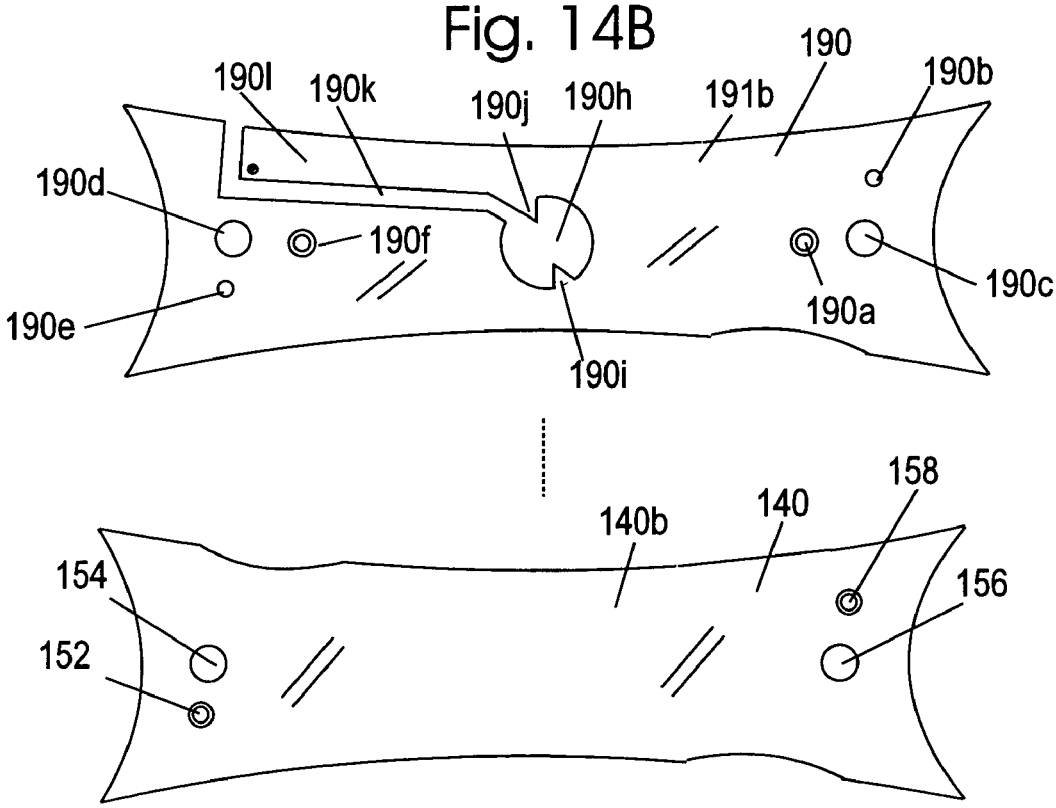
FIG. 14B shows a bottom view of the first plate and the second plate of the second knife.
Figure 15A:
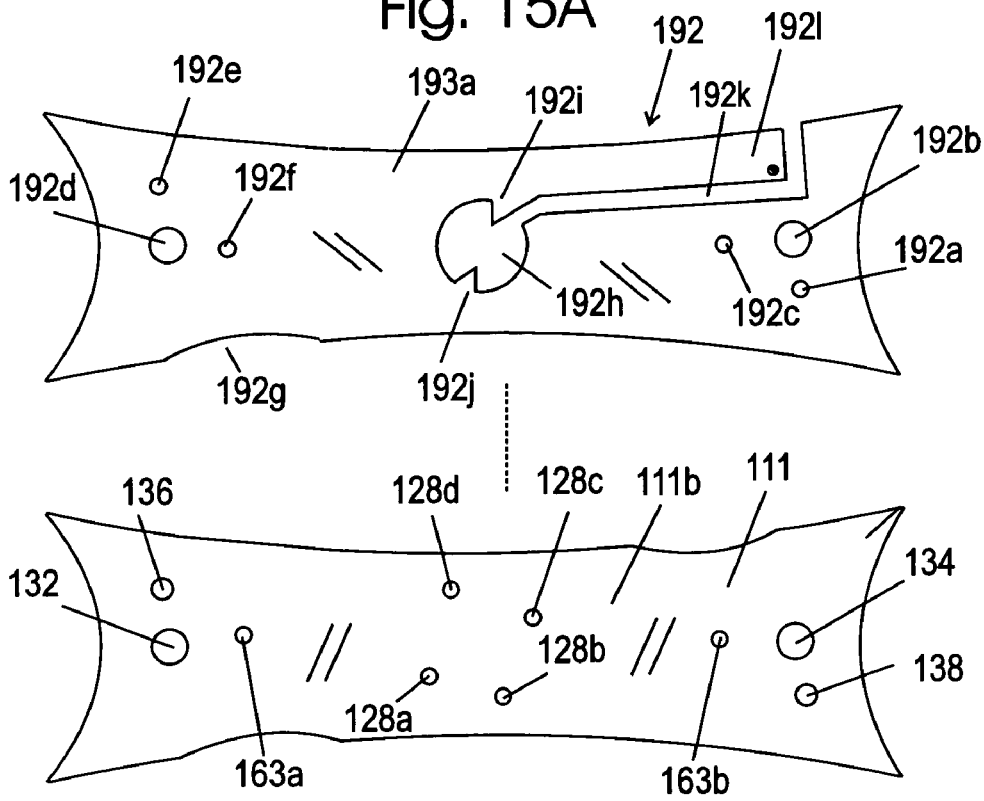
FIG. 15A shows a top view of a third plate and a fourth plate of the second knife.
Figure 15B:
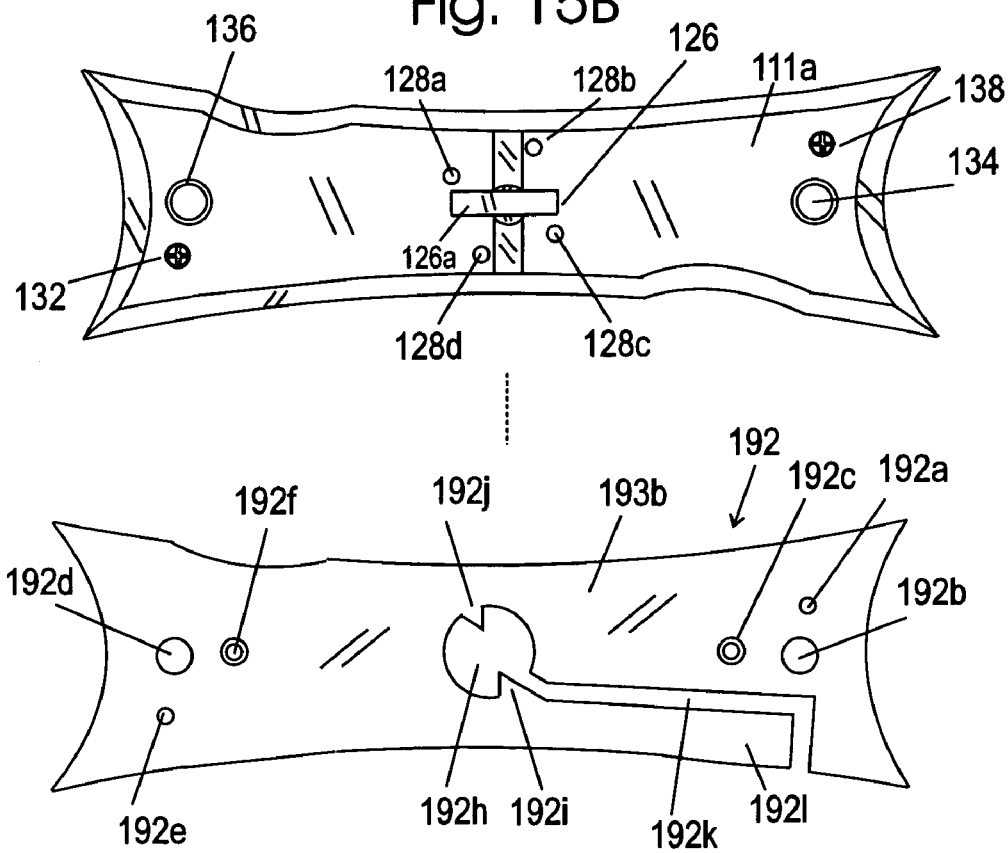
FIG. 15B shows a bottom view of the third plate and the fourth plate of the second knife.
Figure 17:
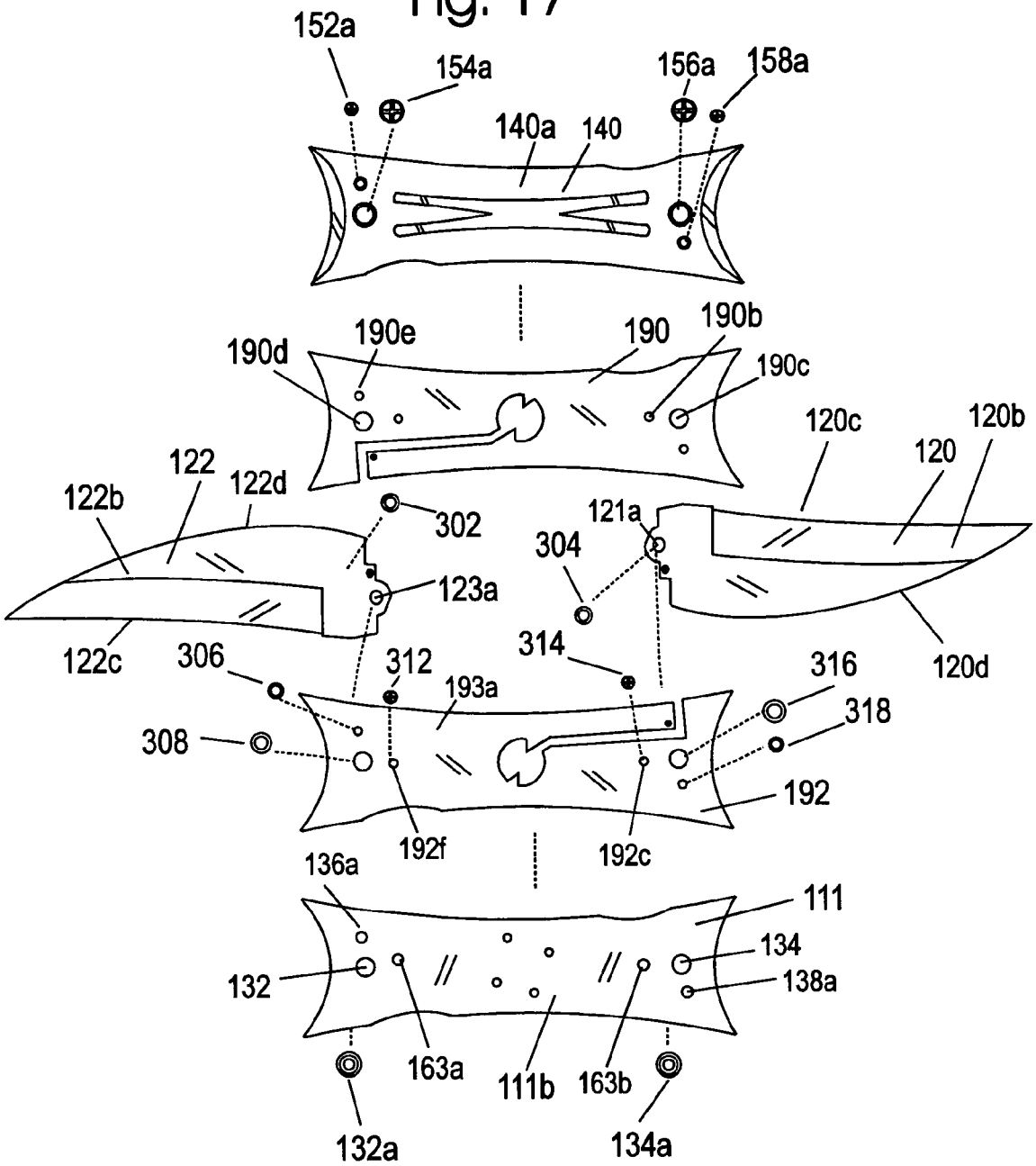
FIG. 17 shows a top view of components of the second knife taken apart.

FIGS. 5A, 5B, 6A, 6B, 7A, and 7B show bottom, top, rear, front, right side, and left side views, respectively of a second knife 100, in accordance with an embodiment of the present invention, wherein the second knife 100 is in a closed state. FIGS. 8A and 8B show right and left side views of the second knife 100 with a first blade 120 and a second blade 122, respectively, in an open state. FIGS. 14A–14B show top and bottom views of a first plate 140 and a second plate 190 respectively, of the second knife 100. FIGS. 15A–15B show top and bottom views of a third plate 192 and a fourth plate 111, respectively, of the second knife 100. FIG. 17 shows a top view of the first knife 100 taken apart.

Referring to FIGS. 5A–8B, 14A–15B, and 17, the second knife 100 includes the first or top plate 140, the second plate 190, the blade 120, the blade 122, the third plate 192 and the fourth or bottom plate 111.

Figure 5A:
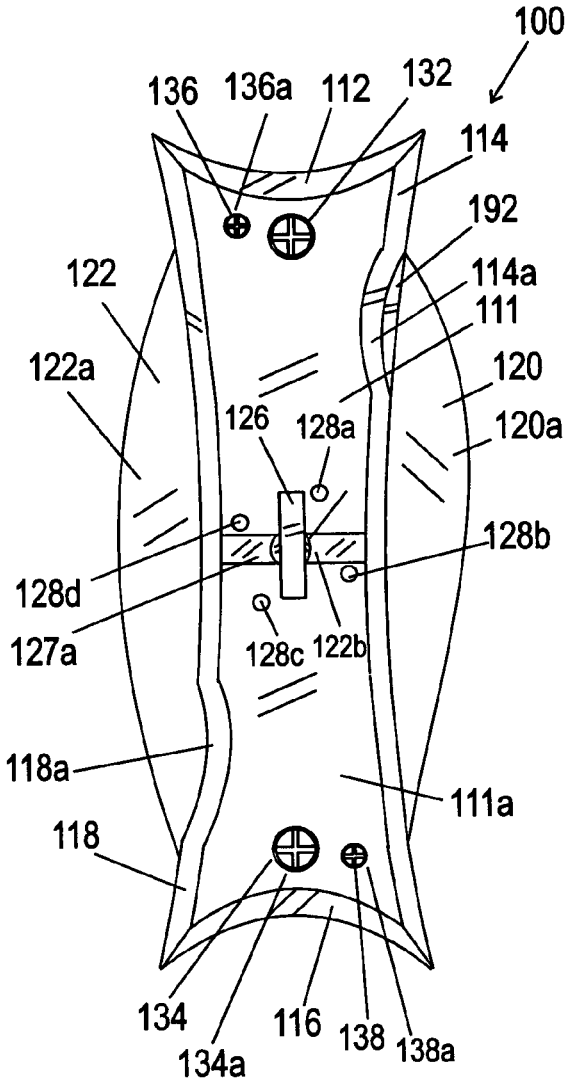
FIG. 5A shows a bottom view of a second knife in accordance with an embodiment of the present invention, with the second knife in a closed state.
Figure 5B:
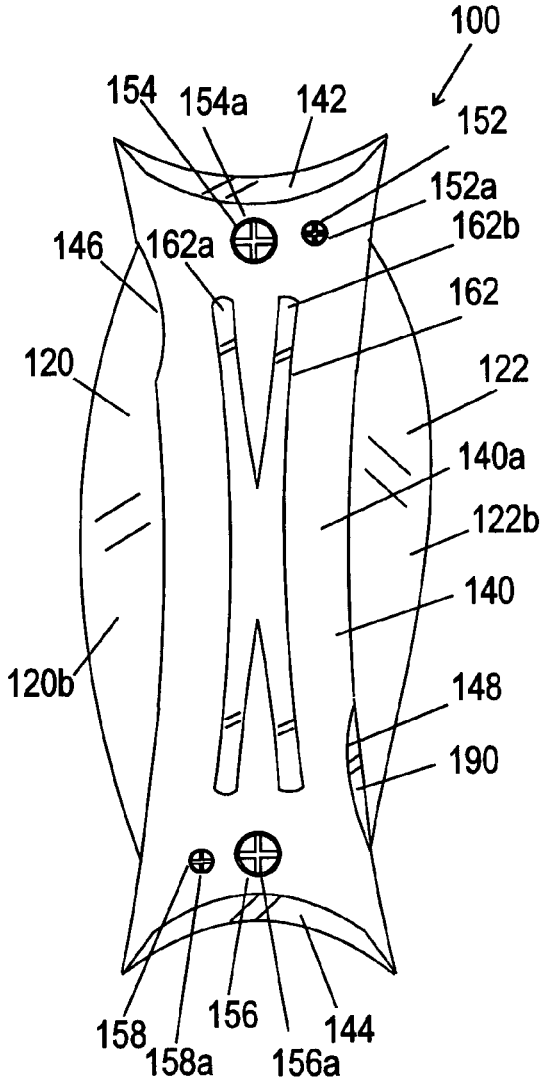
FIG. 5B shows a top view of the second knife of FIG. 5A, with the second knife in a closed state.
Figure 6A:
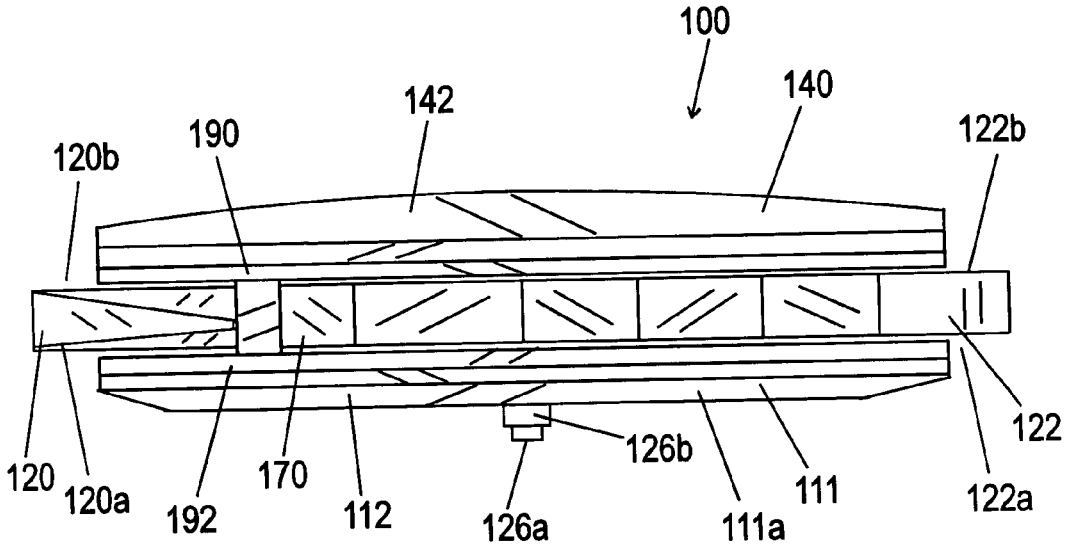
FIG. 6A shows a rear view of the second knife of FIG. 5A, with the second knife in a closed state.
Figure 6B:
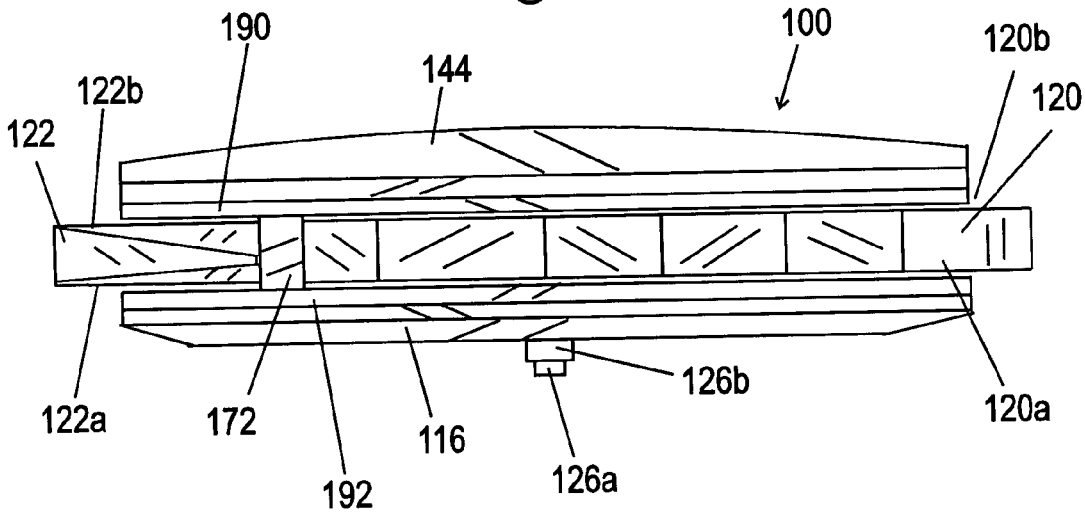
FIG. 6B shows a front view of the second knife of FIG. 5A, with the second knife in a closed state.
Figure 7A:
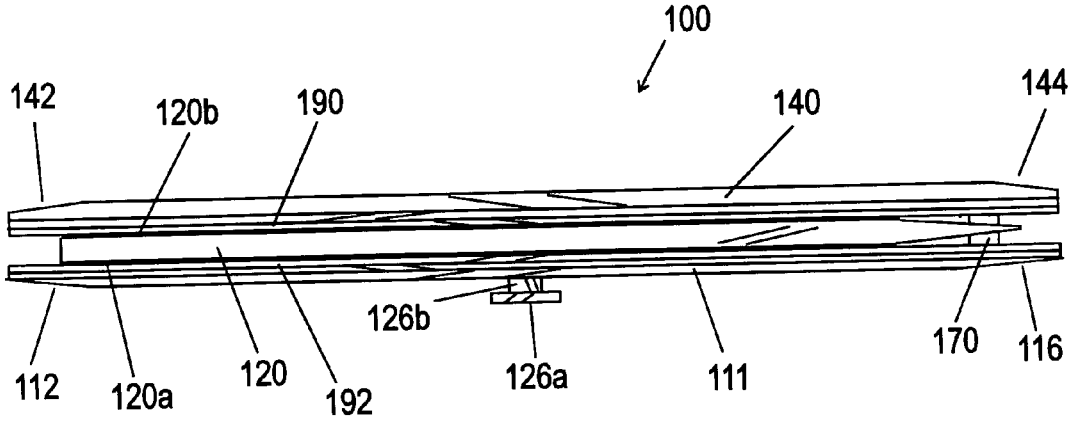
FIG. 7A shows a right side view of the second knife of FIG. 5A, with the second knife in a closed state.
Figure 7B:
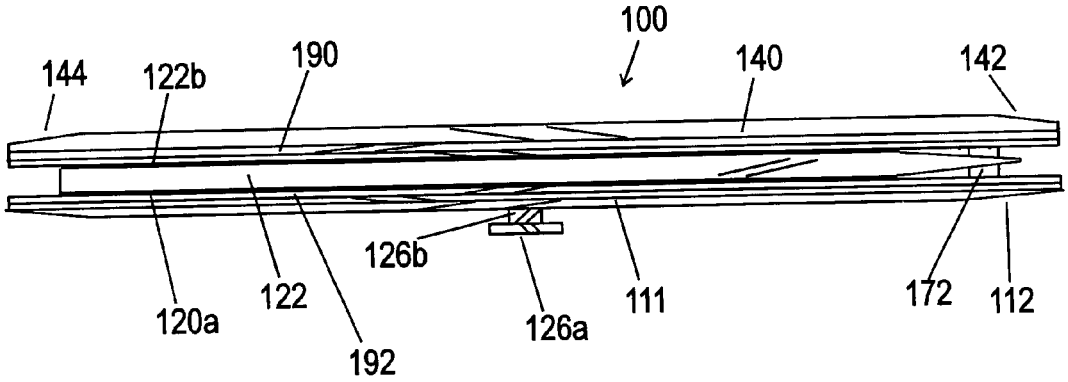
FIG. 7B shows a left side view of the second knife of FIG. 5A, with the second knife in a closed state.

The first or top plate 140 has a surface 140*a* shown in FIG. 5B and FIG. 14A and a surface 140*b* shown in FIG. 14B. The surface 140*a* of the top plate 140 includes tapered fringes or portions 142 and 144. The plate 140 includes indented portions 146 and 148. The top plate 140 has openings 152, 154, 156, and 158 through which screws can be inserted. The top plate 140 has a rubber portion 162 comprised of portions 162*a* and 162*b*.

The second plate 190 has surfaces 191*a* and 191*b* shown by FIGS. 14A and 14B, respectively. The second plate 190 has openings 190*a*, 190*b*, 190*c*, 190*d*, 190*e*, and 190*f*. The second plate 190 has an indented portion 190*g*. The second plate 190 has a central opening 190*h*. Protruding stops or triangular portions 190*i* and 190*j* protrude into the opening 190*h*. There is a flexed portion 190*l*, which is separated from the adjacent part of the second plate 190 by a channel 190*k*. The flexed portion 190*l* as shown in FIG. 14A, may be flexed or biased downwards in a direction into the page.

The blade 120 has a surface 120*a*, a surface 120*b*, a cutting edge 120*c*, and a non-cutting edge 120*d*. The non-cutting edge 120*d* is typically thicker than the cutting edge 120*c*. The blade 120 also has a hole 121*a*. The blade 122 similarly has a surface 122*a*, a surface 122*b*, a cutting edge 122*c*, and a non-cutting edge 122*d*. The non-cutting edge 122*d* is typically thicker than the cutting edge 122*c*. The blade 120 also has a hole 123*a*.

The third plate 192 may be substantially similar to the second plate 190. The third plate has surfaces 193*a* and 193*b* shown in FIGS. 15A and 15B, respectively. The third plate 192 has openings 192*a*, 192*b*, 192*c*, 192*d*, 192*e*, and 192*f*. The third plate 192 has an indented portion 192*g*. The third plate 192 has a central opening 192*h*. Protruding stops or triangular portions 192*i* and 192*j* protrude into the opening 192*h*. There is a flexed portion 192*l*, which is separated from the adjacent part of the third plate 192 by a channel 192*k*. The flexed portion 192*l* as shown in FIG. 15A, may be flexed or biased upwards in a direction out of the page.

The bottom plate 111 has a surface 111*a* shown in FIG. 5A and FIG. 15B. The surface 111*a* of the bottom plate 111 includes tapered fringes or portions 112, 114, 116, and 118. The fringe portion 114 has an indented portion 114*a*. The fringe portion 118 has an indented portion 118*a*. The bottom plate 111 has a substantially centrally located protrusion 126 having a substantially rectangular portion 126*a* attached to a substantially cylindrical portion 126*b*. The bottom plate 111 also has openings 128*a*, 128*b*, 128*c* and 128*d*, surrounding the protrusion 126. The bottom plate 111, including the protrusion 126 and openings 128*a–d*, may be considered an attachment device for attaching the first knife 10 to the second knife 100. The bottom plate 111 also has openings 132, 134, 136, 138, 163*a* and 163*b*, through which screws can be inserted. The bottom plate 111 also has posts 136*a* and 138*a* fixed to it, which have threaded openings for insertion of screws.

Referring to FIG. 17, the second knife 100 may be assembled as follows. The plate 192 may be placed and aligned over the plate 111 so that the surface 193*b* of the plate 192 contacts the surface 111*b* of the plate 11. The plate 192 may then be secured to the plate 111 by attaching a threaded end of screw 312 through openings 192*f* and 163*a* and a threaded end of screw 314 through openings 192*c* and 163*b*. Post screws 134*a* and 132*a* can be inserted through openings 134 and 132, respectively, up through the surface

111*a* through plate 111 and then through the surface 111*b*. Washers 306 and 308 can be placed on post screw 132*a* and on post 136*a*, respectively. Washers 316 and 318 can be placed on post 138*a* and on post screw 134*a*. The blade 120 can be placed on top of the plate 192, so that the surface 120*a* of the blade 120 is adjacent to the surface 193*a* of the plate 192 and a portion of the post 134*a* is inserted through the hole 121*a* of the blade 120. This allows the blade 120 to rotate using the post 134*a* as a pivot point. Similarly, the blade 122 can be placed on top of the plate 192, so that the surface 122*a* of the blade 122 is adjacent to the surface 193*a* of the plate 192 and a portion of the post 132*a* is inserted through the hole 123*a* of the blade 122. This allows the blade 122 to rotate using the post 132*a* as a pivot point.

A washer 304 is placed over the blade 120 so that a portion of the post 134*a* is inserted into the washer 304. Similarly a washer 302 is placed over the blade 122 so that a portion of the post 132*a* is inserted into the washer 302. Next the plate 190 is placed and aligned over the plate 192, with the blades 120 and 122 in between the plate 190 and the plate 192. Part of the post 134*a* is inserted through the opening 190*c* in the plate 190 and part of the post 132*a* is inserted through the opening 190*d*. Part of the post 136*a* is inserted through the opening 190*e* and part of the post 138*a* is inserted through the opening 190*b*. Next, the plate 140 is placed and aligned over the plate 192. Part of the post 134*a* is inserted into the opening 156, part of the post 132*a* is inserted through the opening 154, part of the post 136*a* is inserted through the opening 152 and part of the post 138*a* in inserted through the opening 158. Screw 152*a* is inserted into the opening 152 and connected to the post 136*a*, screw 154*a* is inserted into the opening 154 and connected to the post 132*a*, screw 156*a* is inserted into the opening 156 and connected to the post 134*a*, and screw 158*a* is inserted into the opening 158 and connected to the post 138*a*.

When fully assembled the second knife 100 operates as follows. Each of the blades 120 and 122 can be placed in a closed state as shown in FIGS. 5A–7B, or in an open state as shown by FIGS. 8A and 8B. The blades 120 and 122 may both be in an open state at the same time. When the blade 120 is in the fully open state shown in FIG. 8A, the portion 190*l* of the plate 190 flexes inward towards the plate 192 and thereby contacts the blade 120 keeping the blade 120 in the open position. The blade 120 can only be placed back in the closed position by pushing portion 190*l* of the plate 190 back upwards towards the plate 140, allowing the blade 120 to slide under the plate 190. Similarly, when the blade 122 is in the fully open state shown in FIG. 8B, the plate 192 flexes towards the plate 190 and thereby contacts the blade 122 keeping the blade 122 in the open position. The blade 122 can only be placed back in the closed position by pushing the portion 192*l* of the plate 192 back downwards towards the plate 111, allowing the blade 122 to slide over the plate 192.

Figure 9A:
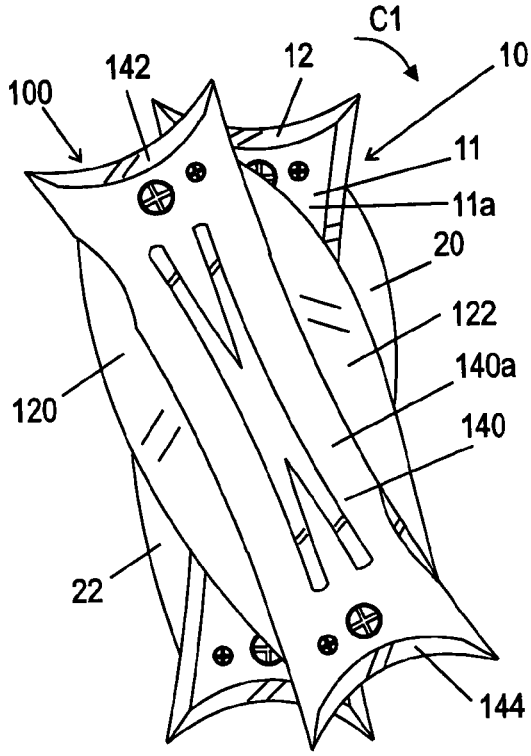
FIG. 9A is a diagram showing the second knife of FIGS. 5A–8B placed on top of the first knife of FIGS. 1A–4B, in a first orientation.

FIGS. 9A–9D, 10A–10D, FIG. 11, and FIG. 13A will help to explain how the first knife 10 and the second knife 100 can be attached together. The second knife 100 may be placed over the first knife 10 as shown by FIG. 9A. In the orientation of FIG. 9A, the portion 142 of the second knife 100 is closer to the portion 12 of the first knife 10 than the portion 144. The second knife 100 is placed at an angle with respect to the first knife 10 so that the protruding portion 126 shown by FIGS. 5A, 6A–B, 7A–7B, 8A–8B, can be inserted into the opening 26 shown in FIGS. 1A, 13A and 13B. Rectangular portion 126*a* fits snugly into the opening 26 and cylindrical portion of the protrusion 126 fits snugly in the circular portion 26*b*. The rectangular portion 126*a* is inserted so that it will go through the plate 11 and will lie in the opening 92*h* of the plate 92 shown in FIG. 13A. When the rectangular portion 126*a* is in the opening 92*h*, the rectangular portion 126*a*, and thus the second knife 100, can be rotated to a limited extent with respect to the first knife 10. Referring to FIG. 13A, the rectangular portion 126*a* can be placed a position 127*a*, shown by dashed lines, where the rectangular portion 126*a* cannot rotate any further in the direction C2 within the opening 92*h* because the portion 126*a* abuts against stops 92*i* and 92*j*. The rectangular portion 126*a* and the knife 100, can be rotated in the opposite direction C3, to a position 127*b*. In this position, the knifes 10 and 100 are aligned. The rectangular portion 126*a* can be rotated further in the direction C3 to a position 127*c* where the rectangular portion 126*a* again abuts the stops 92*i* and 92*j* and cannot rotate any further in the direction C3.

Figure 9B:
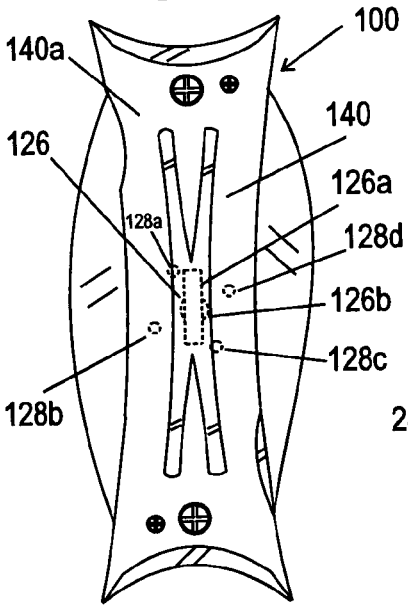
FIG. 9B shows a top view of the second knife and a location of portions of the second knife used to connect the first knife to the second knife.

After the protruding portion 126 has been inserted into the opening 26 the knife 100 can be rotated clockwise in a direction C1, shown by FIG. 9A, while the first knife 10 remains stationary. The second knife 100 is rotated in the clockwise direction C1, until knife 100 is aligned over the first knife 10 (note that the rectangular portion 126*a* as shown by the view of FIG. 13A would move in the opposite direction in FIG. 13A since knife 10 is flipped when connected to knife 100), so that only the second knife 100 can be seen from a top view of the top surface 140*a* of the top plate 140 of the second knife 100, as shown by FIG. 9B. When aligned, the rectangular portion 126*a* would be in position 127*b* in the plate 92 as shown by dashed lines in FIG. 13A.

Figure 9C:
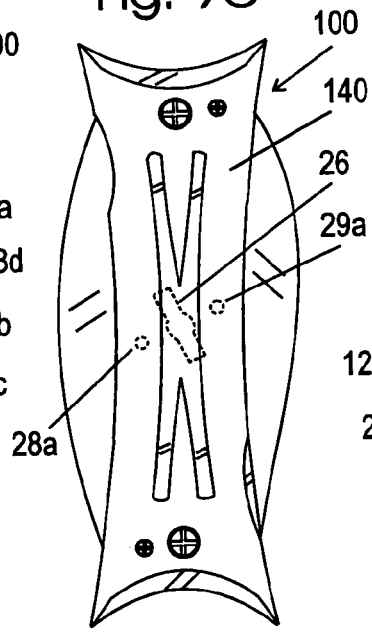
FIG. 9C shows a top view of the second knife and a location of portions of the first knife used to connect the first knife to the second knife.
Figure 9D:
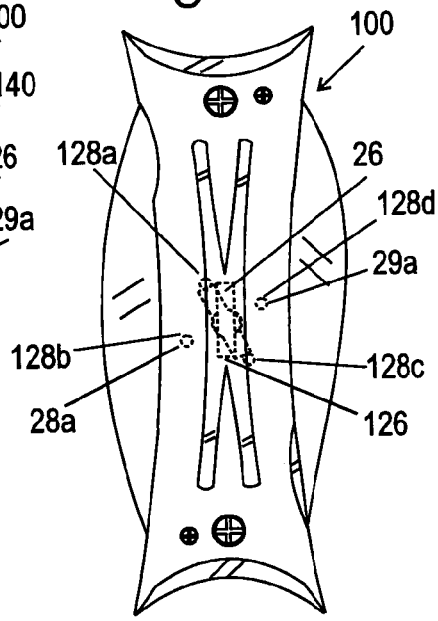
FIG. 9D shows a top view of the second knife and a location of portions of the first knife and portions of the second knife which are used to connect the first knife and the second knife together.

As shown by FIGS. 9B–9D, and 11, the knives 100 and 10 snap together in a position of alignment. FIG. 9B shows by dashed lines, the orientation of protruding portion 126 and openings 128*a–d* after alignment of knives 10 and 100. FIG. 9C shows by dashed lines, the orientation of opening 126 and balls 128*a* and 129*a* after alignment of knives 10 and 100. The ball 29*a* of the first knife 10 moves into the opening 128*d* of the second knife 100. The ball 28*a* of the first knife 10 moves into the opening 128*b* of the second knife 100. FIG. 9D shows by dashed lines, both the orientation of opening 26, protruding portion 126, openings 128*a–d*, and balls 28*a* and 29*a*.

Figure 11:
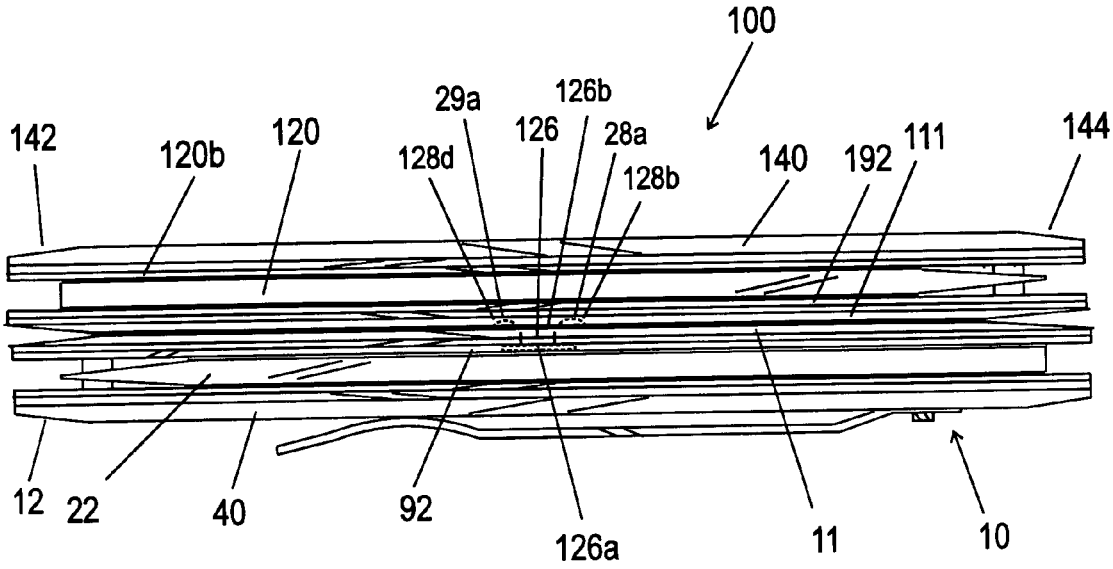
FIG. 11 shows the second knife placed on top of the first knife, with the left side of the first knife visible and the left side of the second knife visible, and with dashed lines showing the locations of first and second balls from the first knife and a protrusion from the second knife.

FIG. 11 shows the second knife 100 on top of and connected to the first knife 10, by the method shown by FIGS. 9A–9D. Ball 29*a* of the first knife 10 is shown in dashed lines inserted into the opening 128*d* of the second knife 100. Ball 28*a* is shown in dashed lines inserted into the opening 128*b* of the second knife 100. The portion 126*a* of the protrusion 126 of the second knife 100 is shown inserted into plate 92 of the first knife 10 and the portion 126*b* is shown inserted into plate 11 of the first knife 10.

Figure 10A:
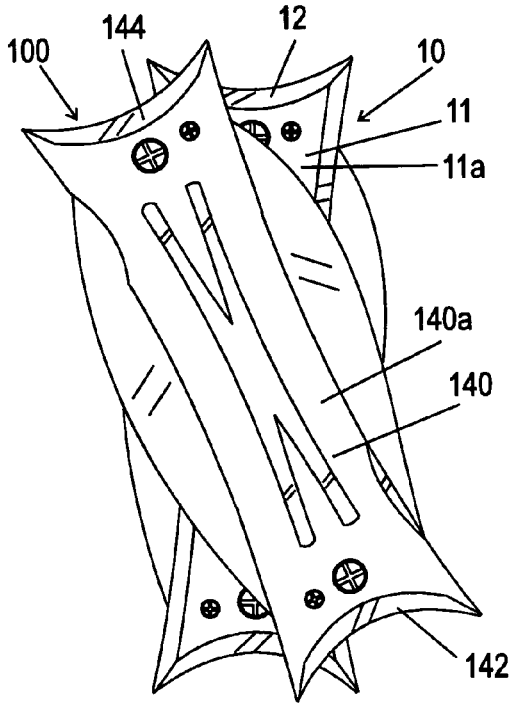
FIG. 10A is a diagram showing the second knife of FIGS. 5A–8B placed on top of the first knife of FIGS. 1A–4B, in a second orientation.
Figure 10B:
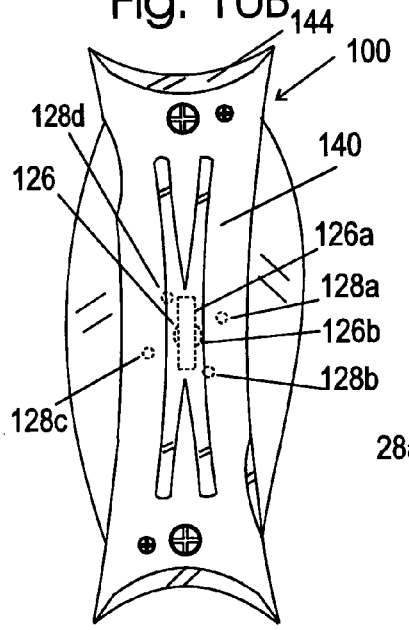
FIG. 10B shows a top view of the second knife and a location of portions of the second knife used to connect the first knife.
Figure 10C:
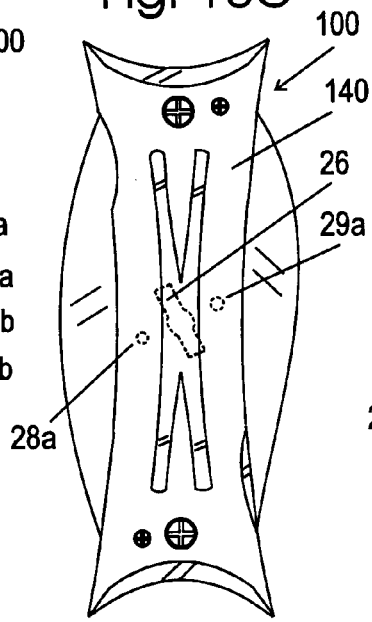
FIG. 10C shows a top view of the second knife and a location of portions of the first knife used to connect the first knife to the second knife.
Figure 10D:
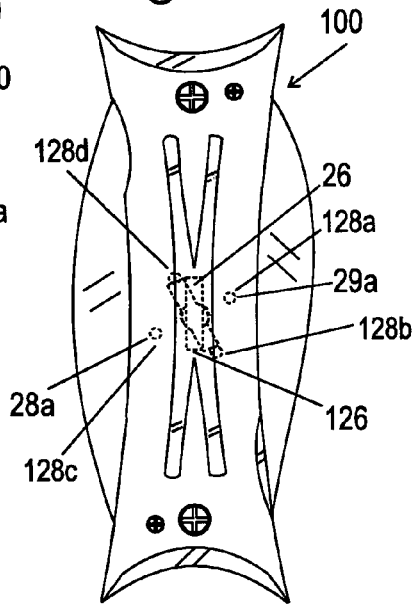
FIG. 10D shows a top view of the second knife and a location of portions of the first knife and portions of the second knife which are used to connect the first knife and the second knife together.

The arrangement of the four openings 128*a–d* allows the second knife 100 to be placed over the first knife 10 in a second manner as shown in FIG. 10A. FIGS. 10A–10D are similar to FIGS. 9A–9D, with the exception that in FIG. 10A the second knife 100 is placed so that the portion 144 is closer to the portion 12 of the first knife 10 than portion 142, while in FIG. 9A the portion 142 is closer to the portion 12 of the first knife 10. For the arrangement and method of FIG. 10A–10D, the balls 29*a* and 28*a* will move into the holes 128*a* and 128*c*, respectively, in order to align the second knife 100 with the first knife 10.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first knife;

a second knife;

wherein the first knife includes a first attachment device;

wherein the second knife includes a second attachment device;

wherein the first attachment device and the second attachment device can be attached to each other to attach the first knife to the second knife;

wherein the first attachment device and the second attachment device can be detached from each other to detach the first knife from the second knife;

wherein the first attachment device is comprised of a first plate having an opening;

wherein the second attachment device is comprised of a protrusion;

wherein the protrusion of the second attachment device can be inserted into the opening of the first plate to attach the first knife to the second knife;

wherein the second attachment device is comprised of a second plate attached to the protrusion; and wherein the first attachment device is comprised of a third plate having an opening which is substantially aligned with the opening of the first plate, end wherein the protrusion can be inserted into the opening of the third plate to attach the first knife to the second knife; and wherein the protrusion can only be inserted into the openings of the first plate and the third plate when the second plate is at an angle with respect to the first plate and the third plate;

and wherein after the protrusion has been inserted into the openings of the first plate and the third plate, and while the protrusion resides in the openings of the first plate and the third plate, the second plate can be put into alignment with respect to the first plate and the third plate by rotating the second plate with respect to the first and the third plates until the second plate becomes aligned with respect to the first and the third plates.

2. The apparatus of claim 1 wherein the first knife is a folding type knife; and the second knife is a folding type knife.

3. The apparatus of claim 2 wherein the first knife is comprised of first and second blades; and the second knife is comprised of third and fourth blades.

4. The apparatus of claim 3 wherein the first and second blades can rotate from a closed position within the first knife to an open position;

and wherein the third and fourth blades can rotate from a closed position within the second knife to an open position.

5. The apparatus of claim 1 further wherein the first knife is comprised of a first blade; and wherein the third plate has a portion which flexes to keep the first blade in an open position.

6. The apparatus of claim 1 further wherein the opening in the third plate is configured to permit the protrusion to be rotated to a limited extent, while the protrusion is in the opening of the third plate.

7. The apparatus of claim 6 wherein the opening in the third plate is circular with the exception of two stops which protrude into the opening of the third plate and prevent the protrusion of the second attachment device from rotating three hundred and sixty degrees while in the opening of the third plate.

8. The apparatus of claim 1 further comprising first and second protruding stops;

wherein the first and second protruding stops protrude into the opening of the third plate of the first attachment device and prevent the first knife from rotating more than one hundred and eighty degrees with respect to the second knife, after the second knife is attached to the first knife.

9. The apparatus of claim 1 wherein the first knife has a clip.

10. An apparatus comprising:

a first knife;

a second knife;

wherein the first knife includes a first attachment device;

wherein the second knife includes a second attachment device;

wherein the first attachment device and the second attachment device can be attached to each other to attach the first knife to the second knife;

wherein the first attachment device and the second attachment device can be detached from each other to detach the first knife from the second knife;

wherein the first attachment device is comprised of a first plate having an opening;

wherein the second attachment device is comprised of a protrusion attached to a second plate;

wherein the protrusion of the second attachment device cart be inserted into the opening of the first plate to attach the first knife to the second knife;

wherein the opening in the first plate of the first attachment device has a first substantially rectangular portion, a substantially circular portion, and a second substantially rectangular portion;

wherein the protrusion can only be inserted into the opening of the first plate when the second plate is at an angle with respect to the first plate, and wherein after the protrusion has bean inserted into the opening of the first plate, and while the protrusion resides in the opening of the first plate, the second plate can be put into alignment with respect to the first plate by rotating the second plate with respect to the first plate until the second plate becomes aligned with respect to the first plate.

11. An apparatus comprising:

a first knife;

a second knife;

wherein the first knife includes a first attachment device;

wherein the second knife includes a second attachment device;

wherein the first attachment device and the second attachment device can be attached to each other to attach the first knife to the second knife; and wherein the first attachment device and the second attachment device can be detached from each other to detach the first knife from the second knife;

wherein the first attachment device is comprised of a first plate having an opening;

wherein the second attachment device is comprised of a protrusion;

wherein the protrusion of the second attachment device can be inserted into the opening of the first plate to attach the first knife to the second knife;

wherein the second attachment device is comprised of a second plate attached to the protrusion;

wherein first and second rotating balls are attached to the first plate, so that the balls can rotate but remain in the same position;

the second plate includes a first ball opening and a second ball opening; and wherein the first rotating ball can be inserted into the first ball opening and the second rotating ball can be inserted into the second ball opening in order to lock the first knife in a first position with respect to the second knife.

12. The apparatus of claim 11 wherein the second plate includes a third ball opening and a fourth ball opening; and wherein the first rotating ball can be inserted into the third ball opening and the second rotating ball can be inserted into the fourth ball opening in order to lock the first knife in a second position with respect to the second knife; and wherein the first position differs from the second position.

13. A method comprising the steps of:

attaching a first attachment device of a first knife to a second attachment device of a second knife, in order to attach the first knife and the second knife together; and detaching the first attachment device of the first knife from the second attachment device of the second knife in order to detach the first knife from the second knife;

wherein the first attachment device is comprised of a first plate having an opening;

wherein the second attachment device is comprised of a protrusion;

and further comprising inserting the protrusion of the second attachment device into the opening of the first plate to attach the first knife to the second knife.

wherein the second attachment device is comprised of a second plate attached to the protrusion;

wherein the first attachment device is comprised of a third plate having an opening, which is substantially aligned with the opening of the first plate, and further comprising inserting the protrusion into the opening of the third plate to attach the first knife to the second knife; and wherein the protrusion can only be inserted into the openings of the first plate and the third plate when the second plate is at an angle with respect to the first plate and the third plate;

and wherein after the protrusion has been inserted into the openings of the first plate and the third plate, and while the protrusion resides in the openings of the first plate and the third plate the second plate can be put into alignment with respect to the first plate and the third plate by rotating the second plate with respect to the first and the third plates until the second plate becomes aligned with respect to the first and the third plates.

14. The method of claim 13 further comprising configuring the first knife to be a folding type knife; and configuring the second knife to be a folding type knife.

15. The method of claim 14 further comprising providing the first knife with first and second blades; and providing the second knife with third and fourth blades.

16. The method of claim 15 further comprising flexing a portion of the third plate to keep the first blade in an open position.

17. The method of claim 14 further comprising providing the first knife with a first blade; and flexing a portion of the third plate to keep the first blade in an open position.

18. The method of claim 13 further comprising providing the first knife with a first blade; and flexing a portion of the third plate to keep the first blade in an open position.

19. The method of claim 13 further comprising inserting first and second protruding stops into the opening of the third plate of the first attachment device;

wherein the first and second protruding stops prevent the first knife from rotating more than one hundred and eighty degrees with respect to the second knife, after the second knife is attached to the first knife.

20. A method comprising the steps of:

attaching a first attachment device of a first knife to a second attachment device of a second knife, in order to attach the first knife and the second knife together; and detaching the first attachment device of the first knife from the second attachment device of the second knife in order to detach the first knife from the second knife;

wherein the first attachment device is comprised of a first plate having an opening;

wherein the second attachment device is comprised of a protrusion attached to a second plate;

and further comprising inserting the protrusion of the second attachment device into the opening of the first plate to attach the first knife to the second knife;

configuring the opening in the first plate of the first attachment device to have a first substantially rectangular portion, a substantially circular portion, and a second substantially rectangular portion; and wherein the protrusion can only he inserted into the opening of the first plate when the second plate is at an angle with respect to the first plate;

and wherein after the protrusion has been inserted into the opening of the first plate, and while the protrusion resides in the opening of the first plate, the second plate can be put into alignment with respect to the first plate by rotating the second plate with respect to the first plate until the second plate becomes aligned with respect to the first plate.

* * * * *